United States Patent [19]

Ray et al.

[11] 4,400,212

[45] Aug. 23, 1983

[54] COBALT-CHROMIUM ALLOYS WHICH CONTAIN CARBON AND HAVE BEEN PROCESSED BY RAPID SOLIDIFICATION PROCESS AND METHOD

[75] Inventors: Ranjan Ray, Burlington; Viswanathan Panchanathan, N. Billerica, both of Mass.

[73] Assignee: Marko Materials, Inc., No. Billerica, Mass.

[21] Appl. No.: 340,481

[22] Filed: Jan. 18, 1982

[51] Int. Cl.[3] ..... B22F 1/00

[52] U.S. Cl. ..... 75/251; 148/425; 148/442

[58] Field of Search ..... 75/251-255; 420/436, 440; 148/425, 442

[56] References Cited

U.S. PATENT DOCUMENTS

| | | | |
|---|---|---|---|
| 1,602,995 | 10/1926 | Wissler | 420/436 |
| 2,551,170 | 5/1951 | Schmacker, Jr. et al. | 420/440 |
| 3,313,633 | 4/1967 | Longo | 420/436 |
| 3,563,731 | 2/1971 | Cope | 420/436 |
| 4,290,808 | 9/1981 | Ray | 75/251 |
| 4,297,135 | 10/1981 | Giessen et al. | 148/425 |

*Primary Examiner*—Michael L. Lewis

[57] ABSTRACT

New cobalt base alloys containing chromium and carbon are disclosed. The alloys are subjected to rapid solidification processing (RSP) technique which produces cooling rates between $10^5$ to $10^7$oC/sec. The as-quenched ribbon, powder etc. consists predominantly of amorphous phase. The amorphous phase is subjected to suitable heat treatments so as to produce a transformation to a microcrystalline alloy which includes carbides; this heat treated alloy exhibits superior mechanical properties for numerous industrial applications.

1 Claim, No Drawings

COBALT-CHROMIUM ALLOYS WHICH CONTAIN CARBON AND HAVE BEEN PROCESSED BY RAPID SOLIDIFICATION PROCESS AND METHOD

BACKGROUND OF THE INVENTION

This invention relates to rapidly solidified cobalt-chromium alloys obtained by adding small amounts of carbon. This invention also relates to the preparation of these materials in the form of rapidly solidified powder and consolidation of these powders into bulk parts which are suitably heat treated to have desirable mechanical properties.

DESCRIPTION OF THE PRIOR ART

Rapid solidification processing techniques offer outstanding prospects for the creation of new breeds of cost effective engineering materials with superior properties (See Proceedings, Second Int. Conf. on Rapid Solidification Processing, Reston, Va., March 1980, published by Claitor's Publishing Division, Baton Rouge, La., 1980). Metallic glasses, microcrystalline alloys, highly supersaturated solid solutions and ultrafine grained alloys with highly refined microstructures, in each case often having complete chemical homogeneity, are some of the products that can be made utilizing rapid solidification processing (RSP). (See Rapidly Quenched Metals, 3rd Int. Conf., Vol 1 and 2, B. Cantor. Ed., The Metals Society, London, 1978.)

Several techniques are well established in the state of the art to economically fabricate rapidly solidifieed alloys (at cooling rate of $10^5$ to $10^7$ °C./sec) as ribbons, filaments, wire, flakes or powders in lage quantities. One well known example is melt spin chill casting, whereby the melt is spread as a thin layer on a conductive metallic substrate moving at high speed (see Proc. Int. Conf. on Rapid Solidification Processing, Reston, Va., November 1977, P. 246) whereby a rapidly solidified thin ribbon is formed.

Design of alloys made by conventional slow cooling processes is largely influenced by the corresponding equilibrium phase diagrams, which indicate the existence and coexistence of the phases present in thermodynamic equilibrium. Alloys prepared by such processes are in, or at least near, equilibrium. The advent of rapid quenching from the melt has enabled materials scientists to stray further from the state of equilibrium and has greatly widened the range of new alloys with unique structure and properties available for technological applications.

Alloys of cobalt and chromium with tungsten or molybdenum, or both, are now made by a number of manufacturers in a variety of grades covering a wide range of hardness and other properties. The softer and tougher compositions are used for high-temperature applications such as gas-turbine vanes and buckets. The harder grades discussed here are used for resistance to wear.

For tool applications, these alloys usually contain by weight from 25 to 32% Cr. The tungsten and molybdenum contents vary from 4 to 25%, or preferably from 6 to 20%, depending on the hardness desired. Carbon, present in amounts from 1 to 3%, exerts a marked hardening effect. The carbon content generally increases as the tungsten content increases. Manganese and silicon are present as deoxidizers, and other elements, such as vanadium, boron, tantalum, columbium and nickel, may be added to impart other special properties. Small amounts of iron or nickel are always present, usually as impurities; however, the nickel may be added intentionally to soften and toughen the alloys.

Table 1 indicates the property trends of these materials. Unlike steels, the harder grades are generally weaker than the softer grades. This is reflected in both tensile and impact strengths.

TABLE 1

Properties of Hard, Medium and Soft Cobalt-Base Alloys as Influenced by Tungsten and Carbon Contents

| Tungsten and carbon content | Rockwell C hardness | Tensile strength, psi | Impact resistance, ft-lb | Castability | Machinability |
|---|---|---|---|---|---|
| 18% W, 2.5% C | 62 | 50,000 | 2 to 3 | Poor | Finished by grinding only |
| 11% W, 2% C | 53 | 78,000 | 3 to 4 | Fair to good | Simple machining with carbide tools |
| 4% W, 1% C | 41 | 133,000 | 8 to 10 | Good | Relatively easy to machine and grind |

Outstanding resistance to wear makes these alloys suitable for metal-cutting tools and certain machinery part. The success of their applications results from their "red Hardness"—that is, their ability to retain hardness and strength at high temperatures. High speed steel makes better cutting tools than carbon tool steel because high speed steel has a higher hardness at elevated temperature. Similarly, the cast cobalt-base alloys are generally superior to high speed steel in performance and life because of their retention of hardness at elevated temperatures.

Red hardness also makes these alloys more capable of resisting wear under almost all conditions where high local surface temperatures are developed. Resistance to tempering effects is great because the alloys do no undergo phase changes or transformations. Additionally, these alloys have comparatively low coefficients of friction, which means that they develop lower temperatures in slidding contact; therefore, they remain hard.

The cobalt-chromium-tungsten alloys have certain disadvantages of being generally weaker and less ductile than high speed steels. For these reasons, in tool form, they should not be subjected to extreme conditions of stress that might cause breakage.

The metallographic structure of the medium and hard cast alloys is complicated. The most noticeable constituent is a large hexagonal carbide crystal that usually appears in an elongated or accicular (needle-like) form and can be identified as the chromium carbide ($Cr_7C_3$) in which some of the chromium may be replaced by cobalt or tungsten, or both. The matrix consists of various binary and ternary eutectics containing all the constiuents of the alloy.

This structure is generally stable at temperatures as high as 1800° to 1900° F.

Metal-cutting tools are made from alloys of the hard type. Medium grades are used for parts subjected to wear and requiring greater impact resistance. Soft grades are used for valves, hot trimming dies and the like. The soft grades are also produced in large sheets and plates by forging and rolling at very high temperatures.

The medium grades have been used for anti-friction bearings in environments in which they will be exposed, without lubrication, to temperatures up to about 1200° F. and oxidizing conditions. Oxidation resistance and the ability to retain strength and hardness after long exposure to these temperatures are of prime importance in this type of application.

SUMMARY OF THE INVENTION

This invention features a class of cobalt-base alloys having high strength, high hardness and high thermal stability when the production of these alloys includes a rapid solidification process. These alloys can be described by the following compositions:

$$Co_aCr_bM_cM^1_dC_eB_f \quad [A]$$

wherein Co, Cr, C and B are cobalt chromium, carbon and boron respectively. M is one element from the group consisting of tungsten and molybdenum or mixtures thereof, and $M^1$ is at least one element from the group consisting of iron, nickel, manganese and vanadium and mixtures thereof, and wherein a,b,c,d,e, and f represent the ranges of atom percentages having the values a=25–73, b=15–35, c=2–20, d=0–10, e=7–17 and f=1–5 respectively with the provisos that (e+f) may not exceed 20 and may not be less than 10, and the sum (a+b+c+d+e+f) must be 100. Preferred lower limits are 20 for b (from example 20); 10 for e (from example 14); 14 for e+f (from example 1); while the preferred limit for f is 4 (from example 4).

Rapid solidification processing (RSP) (i.e. processing in which the liquid alloy is subjected to cooling rates of the order of $10^5$ and $10^7$ °C./sec) of such alloys produces predominantly a metallic glass (i.e. amorphous) structure which is chemically homogeneous and can be heat treated and/or thermomechanically processed so as to form crystalline alloy with ultrafine grain structure. The alloy is prepared as rapidly solidified ribbon by melt spinning techniques. The as quenched ribbon is brittle and is readily comminuted to a staple or powder using standard pulverization techniques e.g. a rotating hammer mill. The powder is consolidated into bulk shapes using conventional hot consolidation methods, for example, hot extrusion or cold pressing and sintering. The consolidated alloy is optionally heat treated to obtain optimum microstructures. The final transformed product is tough with good mechanical properties.

DETAILED DESCRIPTION OF THE INVENTION

In accordance with the present invention cobalt base alloys containing 15–35 atom percent of chromium are alloyed with the following elements; 2–20 atom percent W and Mo, either singly or combined, 0–10 atom percent of Fe, Ni, Mn and V either singly or combined, 7–17 atom percent of C and 1–5 atom percent of B. The alloys may also contain limited amounts of other elements which are commercially found in cobalt base alloys without changing the essential behaviour of the alloys. Typical examples include $Co_{67}Cr_{15}W_5C_{10}B_3$, $Co_{52}Cr_{20}W_5Mo_2Ni_2C_{15}B_4$, $Co_{52}Cr_{25}Mo_3Fe_2Ni_3C_{14}B_1$, $Co_{45}Cr_{30}W_7C_{14}B_4$, $Co_{39}Cr_{32}W_8V_1Mn_2C_{16}B_2$, $Co_{55.5}Cr_{30}W_{1.5}Mo_1Ni_2C_7B_3$, $Co_{43}Cr_{25}W_{20}C_{10}B_2$, and $Co_{46}Cr_{20}W_2Mo_{18}C_{13}B_1$.

The alloys of the present invention upon rapid solidification processing the melt by melt spin chill casting at cooling rates of the order of $10^5$ to $10^7$ °C./sec form brittle ribbons consisting predominantly of metallic glass (i.e. amorphous) phase with a high degree of compositional uniformity and high hardness (900–1350 Kg/mm$^2$). The brittle ribbons are readily pulverized into powders having particle size less than 4 U.S. mesh using standard comminution techniques. The powder is consolidated into bulk parts, e.g. discs, plates, bars, etc., using powder metallurgical techniques, e.g. hot extrusion, hot isostatic pressing, hot forging, hot rolling, etc., optionally followed by heat treatments for optimum properties.

The above powder has preferred particle size less than 60 mesh (U.S. standard) comprising platelets having an average thickness of less than 0.1 mm and each platelet being characterized by an irregularly shaped outline resulting from fracture thereof.

The bulk alloys are crystalline, such material being tough and having high hardness and strength compared to conventional alloys.

The melt spinning method referred to herein includes any of the processes such as single roll chill block casting, double roll quenching, melt extraction, melt drag, etc., where a thin layer or stratum of metal is brought in contact with a solid substrate moving at a high speed.

When the alloys within the scope of the present invention are solidified by conventional slow cooling processes they inherit segregated microstructures with compositional nonuniformity and hence exhibit poor mechanical properties, low strength, hardness, and ductility/toughness. In contrast, when the alloys are made using RSP techniques followed by heat treatment at high temperatures, preferably between 880° C.–1100° C. for 0.5 to 20 hrs, crystallization of the rapidly solidified glassy phase takes place forming an aggregate of ultrafine crystalline (microcrystalline) phases.

The microcrystalline alloy devitrified from glassy state has matrix grain size of less than about 5 microns, preferably less than 2 micron randomly interspersed with particles of complex carbides and/or borides said particles having an average particle size measured in its largest dimension of less than about 0.5 micron, preferably less than 0.2 micron and said carbide particles being predominantly located at the junctions of at least three grains of fine grained solid solution phase.

The fully heat treated RSP alloys of the present invention exhibit high hardness and good toughness. High hardness of the present alloys is due to ultrafine grain structure which is additionally stabilized and dispersion hardened by ultrafine hard refractory metal (W,Mo) carbides and chromium carbides. As a consequence of rapid solidification processing, it is possible to prodduce a homogeneous predominantly glassy alloy with large amount of interstitial elements e.g. carbon and/or boron. Upon devitrification (i.e. crystallization) of the glassy phase, a homogeneous aggregate of microcrystalline phases form. Conventional cobalt-chromium alloys containing tungsten between 5 to 12 at pct. which are processed by standard slow casting method usually have hardness values ranging between 500 to 700

Kg/mm$^2$. As comparison, the alloys of the present invention possess significantly higher hardness values i.e. between 850 to 1168 Kg/mm$^2$. Such high hardness values combined with uniform microstructures will render them especially suitable for applications as hard, wear resistant materials, e.g. cutting tools, wear strips, agricultural and earthworking equipment, needle, roller and ball bearings etc. A small amount of boron additions to the present alloys has been found to be desirable, since boron has been found to enhance the ribbon fabricability of the alloys by the method of melt spinning. The preferred boron content is less than 5 atom percent. When boron content is greater than 5 atom percent, the microcrystalline alloy devitrified from the glassy state contains excessive amount of borides and carbides which tend to render the alloys less tough.

The carbon content of the present alloys is critical. Besides its significance in improving the hardness at high temperature, it also enhances ribbon fabricability of the alloys by the method of melt spinning. When the carbon content is less than 10 atom percent the alloys are difficult to form as rapidly solidified ribbons by the method of melt deposition on a rotating chill substrate i.e. melt spinning. This is due to the inability of the alloy melts with low carbon contents to form a stable molten pool on the quench surface. Such alloys do not readily spread into a thin layer on a rotating substrate as required for melt spinning.

When the carbon content is greater than 17 atom percent excessive amounts of carbides are formed. The heat treated alloys are very brittle due to excessive amounts of brittle carbide phases exhibiting poor mechanical properties.

Of particular interest in these alloys are the increased strength and hardness.

EXAMPLES 1 TO 6

Alloys of composition given in Table 2 were melt spun into brittle ribbons having thicknesses of 25 to 75 microns by the RSP technique of melt spinning using a rotating Cu-Be cylinder having a quench surface speed of 5000 ft/min. The ribbons were found by X-ray diffraction analysis to consist predominantly of a metallic glass phase. Ductility of the ribbons was measured by the bend test. The ribbon was bent to form a loop and the diameter of the loop was gradually reduced until the loop was fractured. The breaking diameter of the loop is a measure of ductility. The larger the breaking diameter for a given ribbon thickness, the more brittle the ribbon is considered to be i.e. the less ductile. The ribbons show improved bend ductility upon heat treatment at high temperatures, as indicated by lower breaking diameters. Table 2 gives the breaking diameters and hardness values of a number of rapidly solidified alloys of the present invention before and after heat treatment.

TABLE 2

| Example | Alloy Composition (atom percent) | Hardness Kg/mm$^2$ | Breaking dia. (inch) |
|---|---|---|---|
| | | As Quenched Ribbon | |
| 1. | $Co_{43}Cr_{27}Fe_5Ni_3W_8C_{11}B_3$ | 1150 | 0.030 |
| 2. | $Co_{37}Cr_{27}Fe_5Ni_3W_{11}C_{14}B_3$ | 1349 | 0.090 |
| 3. | $Co_{49.3}Cr_{27}Fe_3Ni_3W_{3.5}C_{10}B_4$ | 1110 | 0.126 |
| 4. | $Co_{45}Cr_{25}Fe_5Ni_5W_7C_8B_5$ | 1096 | 0.075 |
| 5. | $Co_{43}Cr_{27}Fe_2Ni_2W_6C_{17}B_3$ | 1225 | 0.030 |
| 6. | $Co_{42}Cr_{27}Fe_3Ni_3W_7C_{13}B_5$ | 1236 | 0.051 |
| | | Heat Treated Ribbon (950° C. for 2 hrs.) | |
| 1. | $Co_{43}Cr_{27}Fe_5Ni_3W_8C_{11}B_3$ | 966 | 0.020 |

TABLE 2-continued

| Example | Alloy Composition (atom percent) | Hardness Kg/mm$^2$ | Breaking dia. (inch) |
|---|---|---|---|
| 2. | $Co_{37}Cr_{27}Fe_5Ni_3W_{11}C_{14}B_3$ | 850 | 0.018 |
| 3. | $Co_{49.3}Cr_{27}Fe_3Ni_3W_{3.5}C_{10}B_4$ | 950 | 0.078 |
| 4. | $Co_{45}Cr_{25}Fe_5Ni_5W_7C_8B_5$ | 819 | 0.061 |
| 5. | $Co_{43}Cr_{27}Fe_2Ni_2W_6C_{17}B_3$ | 1078 | 0.022 |
| 6. | $Co_{42}Cr_{27}Fe_3Ni_3W_7C_{13}B_5$ | 1168 | 0.038 |

EXAMPLES 7 TO 14

50 to 60 gms of selected alloys as given in Table 3 were melt spun as brittle ribbons having thicknesses of 25 to 75 microns by RSP method of melt spinning using a Cu-Be cylinder having a quench surface speed of 5000 ft/min. The ribbons were found by Xray diffraction analysis to consist predominantly of a amorphous phase. The brittle ribbons were pulverized into powder under 230 mesh or staple using a rotating hammer mill.

TABLE 3

| Example | Alloy Composition (atom percent) |
|---|---|
| 7 | $Co_{45}Cr_{27}Fe_4Ni_3W_6C_{12}B_3$ |
| 8 | $Co_{56.5}Cr_{30}Mo_1W_{1.5}C_7B_4$ |
| 9 | $Co_{48}Cr_{32}Mo_2W_2C_{12}B_4$ |
| 10 | $Co_{60}Cr_{15}W_5C_{17}B_3$ |
| 11 | $Co_{50}Cr_{20}W_5Fe_3Ni_2C_{17}B_3$ |
| 12 | $Co_{49}Cr_{25}W_2Mo_4V_1Ni_2C_{15}B_2$ |
| 13 | $Co_{56}Cr_{28}W_2C_{11}B_3$ |
| 14 | $Co_{52}Cr_{29.5}W_{1.5}Mo_1Fe_2Ni_2C_{10}B_2$ |

EXAMPLE 15

The following example illustrates an economical method of continuous production of RSP powder of the cobalt base alloy of the composition indicated by the formula (A) of the present invention.

The cobalt base alloys are melted in any of the standard melting furnaces. The melt is transferred via a ladle into a tundish having a series of orifices. A multiple number of jets are allowed to impinge on a rotating water cooled copper-beryllium drum whereby the melt is rapidly solidified as ribbons. The ascast brittle ribbons are directly fed into a hammer mill of appropriate capacity wherein the ribbons are ground into powders of desirable size ranges.

We claim:

1. Cobalt base alloy powders having composition $Co_aCr_bM_cM'_dC_eB_f$, wherein Co, Cr, C and B respectively represent cobalt, chromium, carbon and boron, M is one element from the group consisting of tungsten and molybdenum or mixtures thereof, M' is at least one element from the group consisting of iron, nickel, manganese and vanadium and mixtures thereof, and a, b, c, d, e, and f represent respectively atom percent of Co, Cr, M, M', C and B having the values a=25–73, b=20–35, c=2–20, d=0–10, e=10–17 and f=1–4 with the provisos that e+f may not exceed 20 and may not be less than 14 and the sum of a+b+c+d+e+f=100, said powders being made by the method comprising the following steps:

(a) forming a melt of said alloy, (b) depositing said melt against a rapidly moving quench surface adapted to quench said melt at a rate in the range approximately $10^5$ to $10^7$°C./second and form thereby a rapidly solidified brittle strip of said alloys characterized by predominantly an amorphous structure and hardness values between 900 and 1350 kg/mm$^2$ and, (c) Comminuting said strip into powders.

* * * * *